US006663312B2

(12) United States Patent
Cary et al.

(10) Patent No.: US 6,663,312 B2
(45) Date of Patent: Dec. 16, 2003

(54) PUPPET ARM CONNECTION AND MOVEMENT SYSTEM

(76) Inventors: John P. Cary, 4800 Merritt Rd., Ypsilanti, MI (US) 48197; David Ray Pannabecker, 405 Aspin Dr., Elkhart, IN (US) 46514

( * ) Notice: Subject to any disclaimer, the term of this patent is extended or adjusted under 35 U.S.C. 154(b) by 0 days.

(21) Appl. No.: 09/903,941

(22) Filed: Jul. 12, 2001

(65) Prior Publication Data

US 2003/0016990 A1 Jan. 23, 2003

(51) Int. Cl.[7] ..... F16B 39/00
(52) U.S. Cl. ..... 403/69; 403/119
(58) Field of Search ..... 403/119, 120, 403/408.1, 69, 71, 316, 317, 300, 267, 22

(56) References Cited

U.S. PATENT DOCUMENTS 5,888,012 A * 3/1999 Nygren et al. ..... 403/22 X
5,896,820 A * 4/1999 Klinkner et al. ..... 403/71 X
5,980,357 A * 11/1999 Newby ..... 446/359

* cited by examiner

*Primary Examiner*—Lynne H. Browne
*Assistant Examiner*—John Cottingham

(57) ABSTRACT

A thin, firm material base (10) with a slotted tube (20) and attached clip (40) assembly inserted through the base and secured to the base (10) with bolt retainers (30). The bolt retainers (30) keep the tube (20) secure within the base (10). The base (10) is encased in a split cylindrical foam material to provide for support, shape and proper alignment when used in an internal application such as a puppet wrist. In addition a rod with a ground end can be temporarily inserted into the tube (20) and attached clip (40) assembly, providing a temporary, yet secure connection while allowing for rotational movement of the rod (60) within the tube (20). The temporarily secure connection is a result of the friction of the inserted rod (60) coming into contact with the straight side of the clip (40) within the interior diameter of the tube (20). For the temporary secure connection to take place, the rod must be inserted into the tube past the point of engaging the straight side of the clip (40) within the interior diameter of the tube (20). The connection can be disengaged by grasping and pulling the rod (60), out of the tube (20), thus releasing the friction between the clip (40) and the rod (60).

2 Claims, 4 Drawing Sheets

PUPPET ARM CONNECTION AND MOVEMENT SYSTEM

CROSS-REFERENCE TO RELATED APPLICATIONS

Not applicable.

STATEMENT REGARDING FEDERALLY SPONSORED

Not Applicable

BACKGROUND

1. Field of Invention

This invention relates to hand-held puppet arm manipulation, specifically to those puppets commonly referred to as rod-arm puppets.

2. Description of Prior Art

Over the past 40 years, hand puppets using rod arms have become increasingly popular. Rod design however, has remained essentially static. The standard for puppet arm manipulation has been a rod with a securement device externally attached (elastic, plastic cable ties, etc). One end of the rod is secured to the puppet's wrist joint. The opposite end is held by the puppeteer. Disadvantages of this system include:

a) Eventual damage to the puppet's external fabric (skin).

b) Compression damage to wrist materials.

c) Rod arm disconnection during inappropriate times such as live performance.

d) Limited range of motion of the puppet hand, wrist, arm, and shoulder joints.

e) An obvious wrist bracelet of elastic (the secure device) that may detract visually.

f) Anatomically inappropriate arm positions (distorted) at inappropriate times if the rod is accidentally dropped but remains attached.

Semi-permanent and permanent rods are also available. They require a device (i.e. alligator clip) implanted into the puppet's wrist or hand. This method also has disadvantages that include, but are not limited to:

a.) Eventual fabric damage at site of insertion.

b.) Permanent attachment without the ability to remove rod during storage.

c.) Rod arm disconnection during inappropriate times such as live performance.

d.) Anatomically inappropriate arm positions (distorted) at inappropriate times if the rod is accidentally dropped but remains attached.

e.) Limited range of motion of the puppet hand, wrist, arm, and shoulder joints.

SUMMARY

Present puppet rod technology includes straight rods attached permanently or semi-permanently, either externally or internally.

OBJECTS AND ADVANTAGES

The present invention has several objects and advantages:

a) To provide a rod arm movement system allowing expanded range of motion that is more realistic.

b) To provide movement of the puppet arm in a vertical line while the rod remains vertical.

c) To provide for pronation and supination (rotation) of the wrist joint and thus the hand.

d) To provide a rod arm/puppet connection that does not deteriorate the materials or fabric of the puppet arm.

e) To provide a rod arm/puppet connection that does not cause compression of the wrist joint.

f) To provide a rod arm/puppet connection without an external bracelet or other securing device that detracts visually.

g) To provide a secure rod arm/puppet connection that can be intentionally disconnected as needed.

h) To provide a secure rod arm/puppet connection that cannot become disconnected without intent.

i) To provide a naturally positioned arm and hand if the rod is accidentally dropped.

Further objectives and advantages are to provide a puppet wrist and rod arm manipulation system that can be built to scale and incorporated into any rod arm puppet, inexpensively without modification to the puppet hand/wrist joint.

DRAWING FIGURES

Figure 1:
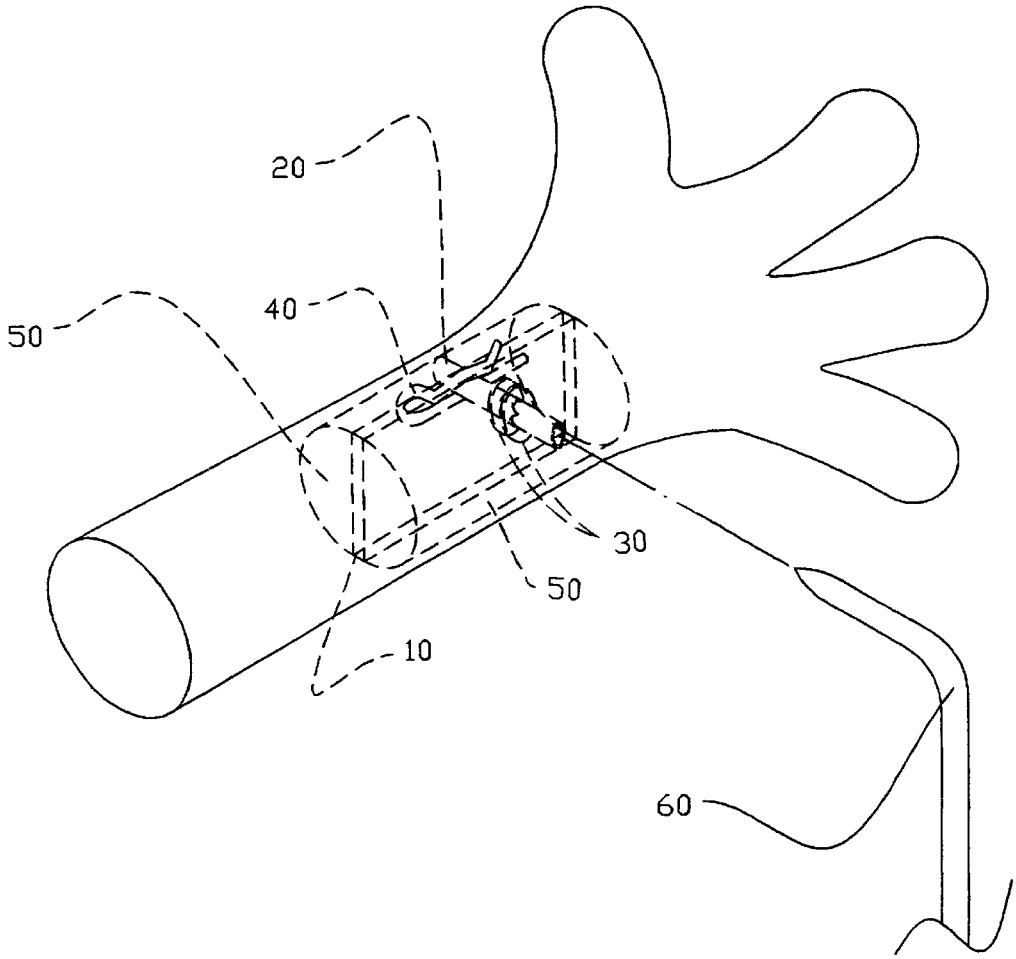
FIG. 1 shows the completed puppet arm insert inside a puppet's arm, along with a rod.
Figure 2:
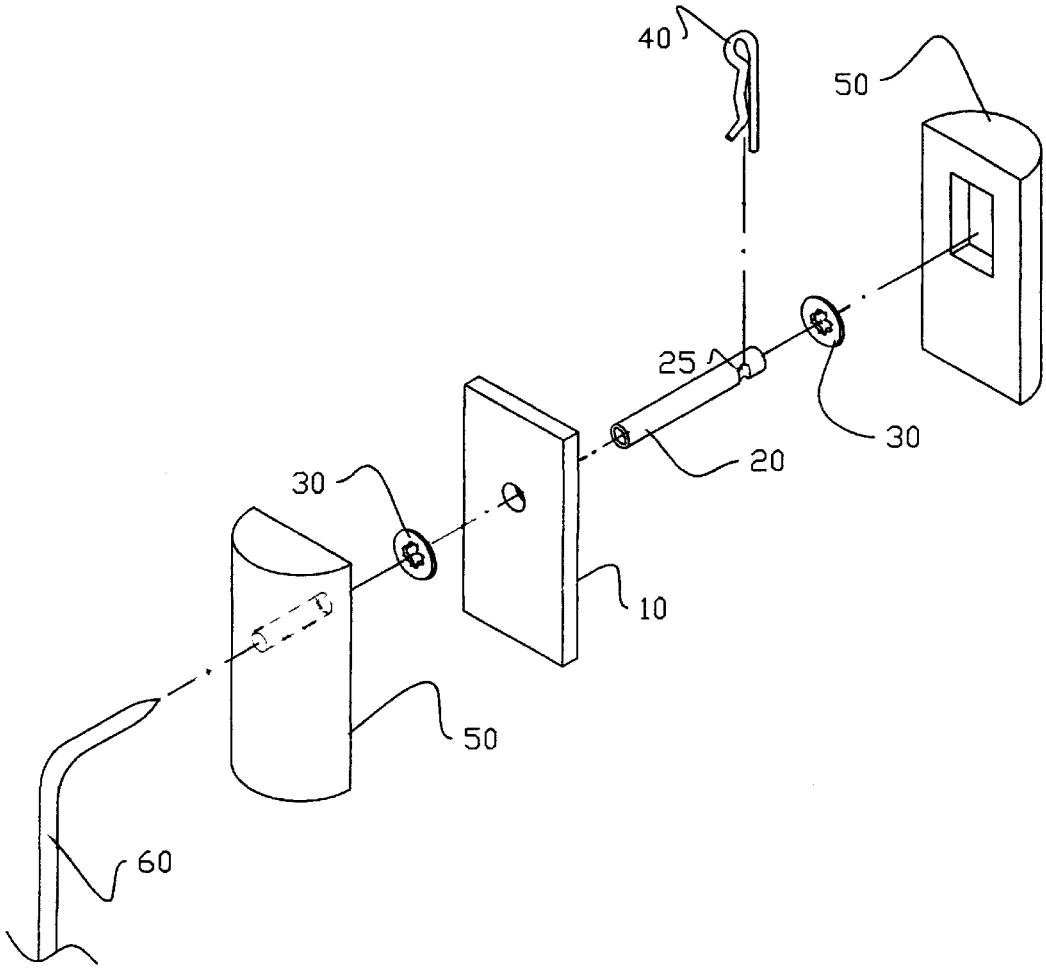
FIG. 2 shows an isometric exploded view of the insert, along with a rod

| REFERENCE NUMERALS IN DRAWINGS | |
|---|---|
| 10 | Base |
| 20 | Brass tube |
| 25 | Slot in brass tube |
| 30 | Bolt retainer |
| 40 | Hair pin clip |
| 50 | Backer rod |
| 60 | Music wire (puppet arm rod) |

DESCRIPTION — FIGS. 1, 2, 3A and 3B — PREFERRED EMBODIMENT

A preferred embodiment of the device of the present system is illustrated in FIG. 1. The temporary puppet rod/wrist connection and movement system is illustrated in an exploded isometric view in FIG. 2. The system consists of two parts. Part 1 is the wrist insert, which includes:

1) 1¼ inch diameter backer rod (50) split lengthwise in half.

2) ⅛ inch thick base (10) rectangle 2 inch ×1 3/16 inch 3) 0.047 inch×19/32 inch hair pin clip (40).

4) 2 number 6 bolt retainers (30).

5) ⅛ inch diameter×1 inch brass tube (20) with a 0.047 inch wide×0.035 deep slot (25) cut ⅙ inch from the bottom end of the tube.

6) Common hot glue.

Part 2 consists of a 3/32 inch diameter wire rod (60). The rod (60) is ground to a dull point at one end and bent to a 90 degree angle 1⅛ inches from the ground end. Total wire rod length is traditionally 21 inches including a handle.

Figure 3A:
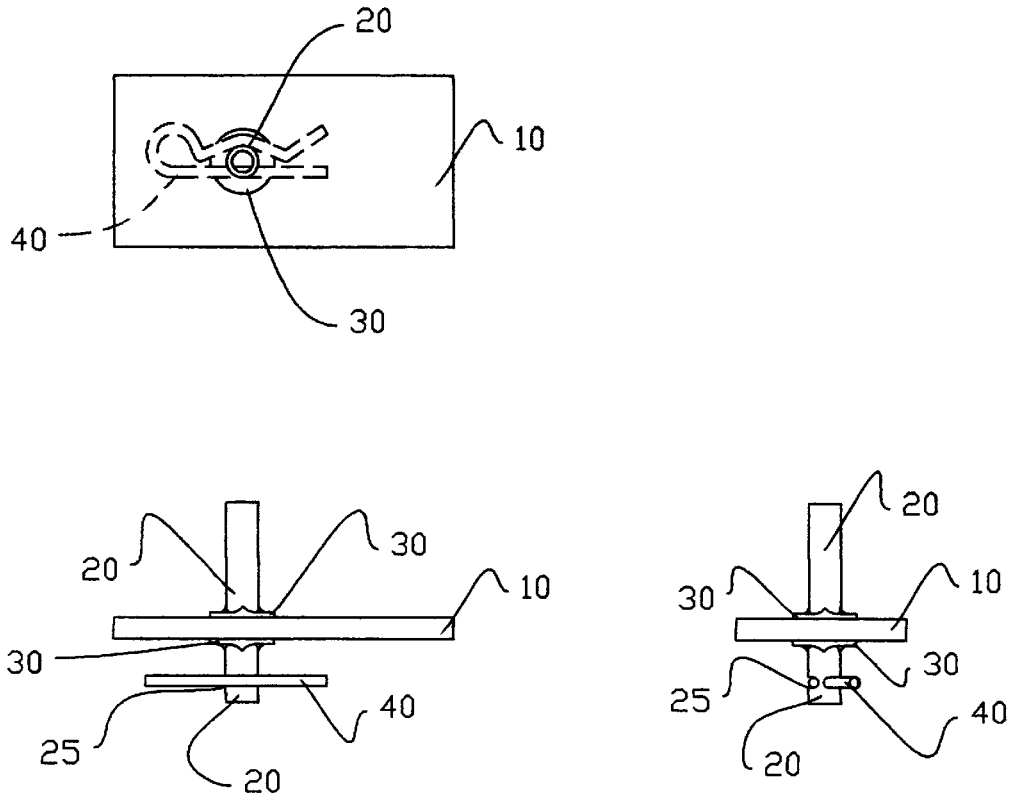
FIG. 3A shows top, side and bottom views of the insert
Figure 3B:
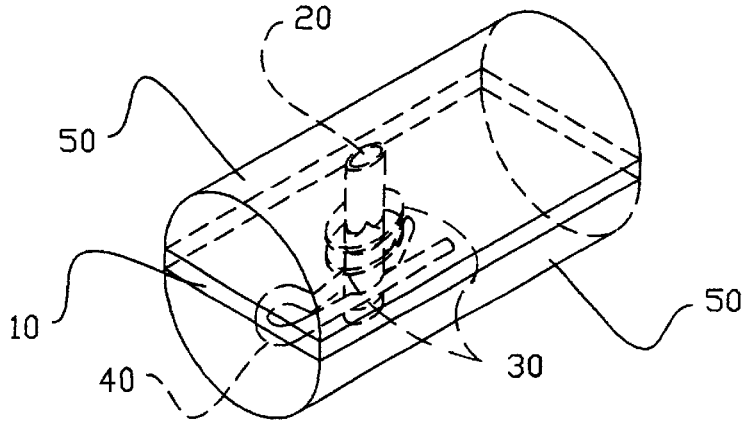
FIG. 3B shows an isometric view of the completed insert assembly, along with a rod
Figure 4:
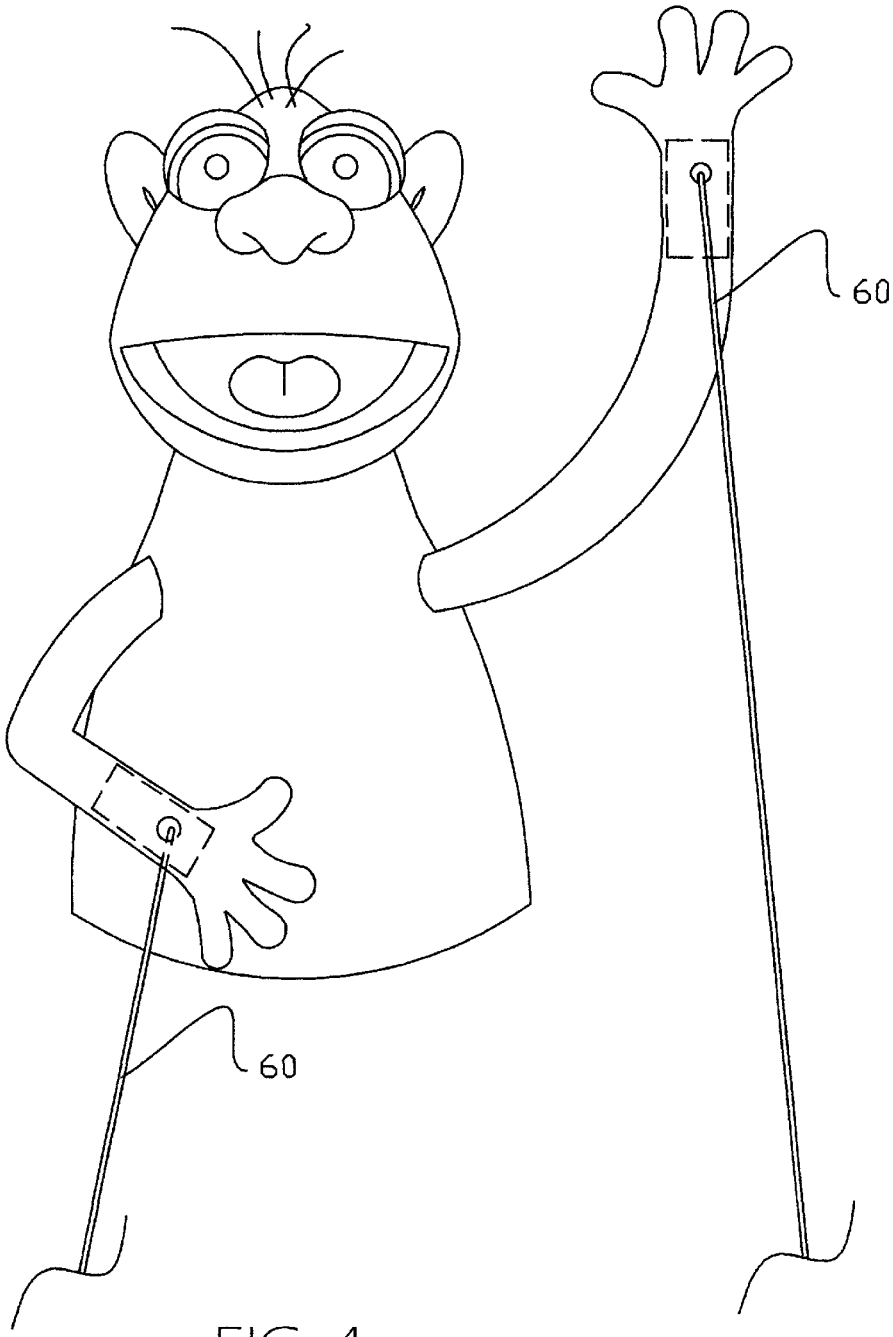
FIG. 4 illustrates a puppet with wrist inserts and connected rods.

As shown in FIG. 3A, the wrist insert has a base (10) made of SINTRA (an EDA plastic), or a similar material. A ⅛ inch diameter drilled hole is located ¾ of an inch from one end and ⅝ of an inch from one side of the base (10). The brass tube (20) protrudes ⅝ of an inch from the top of the base (10) and ¼ of an inch from the bottom of the base (10). Two number 6 bolt retainers (30) secure the brass tube (20) to the base (10) on the top bottom. The straight side of the hairpin clip (40) is attached to the brass tube (20) with the straight side in the slot parallel to the base (10). The straight side of the hairpin clip (40) inserted into the 0.047 inch wide ×0.035 inch deep slot (25) of the brass tube (20) extends partially into the internal diameter of the brass tube (20). Hot glue is applied on the curved portion of the hairpin clip (40) between the hairpin clip (40) and the base (10) to provide added stability to the hairpin clip (40). The straight side of the hairpin clip (40) remains glue free to allow movement of the straight side of the hairpin clip when the rod (60) is inserted into the brass tube (20) engaging the hairpin clip. A small interior cavity created in the bottom half of the backer rod (50) houses the glued hairpin clip (40) secured to the brass tube (20) protruding from the bottom of the base (10). The halves of the backer rod (50) are glued to the top and bottom of the base (10). The top portion of the brass tube (20) goes through and is flush with the top of the backer rod (50). FIG. 3B illustrates a completed puppet wrist insert.

DESCRIPTION — FIGURES ADDITIONAL EMBODIMENT

Not applicable.

ADVANTAGES

From the descriptions given above, advantages of the puppet rod and wrist manipulation system are evident:

a) Puppet arm movement is expanded and more realistic including movement in a vertical line, rotation of the wrist joint, increased range of motion etc.

b) Construction materials are commonly available and inexpensive.

c) The puppet rod and wrist manipulation system can be modified to scale to use in puppets of varying size.

d) The system provides a secure rod arm/puppet connection that will not damage the puppet. This would include things such as compression of the wrist joint and deterioration of the fabric.

e) The small connection located in the wrist is unobtrusive, and will not detract visually.

f) The rod arm/puppet connection remains secure unless intentionally disconnected.

OPERATION — MAIN EMBODIMENT

Hand held puppet rod arm technology has been in need of advancement beyond straight wire and rubber bands for decades. The temporary puppet rod/wrist connection and movement system is comprised of 2 parts, the wrist insert, FIG. 3B, and the rod (60). These combine to advance the art of puppetry to a new level.

The wrist insert, FIG. 3B, provides the connection requirement between the rod (60) and puppet arm. This is accomplished in a hidden manner thus giving the puppet arm a natural look. The base (10) provides stiff support for the brass tube (20). Any rigid material to scale could serve as the base (10). The brass tube (20) is secured to the base (10) using two number 6 bolt retainers (30). The straight side of the hairpin clip (40), located in the slot (25) of the brass tube (20), provides friction to the inserted rod (60). Friction on the inserted rod (60), provided by the hairpin clip (40) against the rod (60) provides a temporary connection between the rod (60) and the tube (20), yet allows rotation of the rod (60) inside the brass tube (20). This prevents unwanted disconnects. At the same time, rotation between the rod (60) and the puppet arm is not restricted. The backer rod (50) provides support and shape for the puppet wrist, as well as assuring proper placement of the base (10)/brass tube (20) assembly within the puppet's wrist. Rod manipulation for the puppeteer using this system remains essentially the same as the current art. However, the puppeteer will find that they can demonstrate movements, that until now, have been impossible.

OPERATIONS — ALTERNATIVE EMBODIMENTS

Not applicable.

CONCLUSION, RAMIFICATIONS AND SCOPE

Accordingly, the reader will understand that this invention, a rod arm puppet movement system, provides the ability to engage in realistic puppet arm movement. The system allows for a temporary secure attachment that can be disconnected when necessary. The securement area is virtually invisible with all connection and disconnection activity occurring at one very small internal point. This leaves the puppet wrist joint essentially untouched. Although the above description contains many specifics, limitations of usage should not be placed on the scope of this invention. These examples should be considered illustrations of the currently preferred embodiments of this invention.

Many variations of usage are possible with this device. For example, this invention could provide connection and support for props. Used in performance, it would allow for easy disconnection between the support rod and the props as needed. In addition, this invention could, with modification of the components to scale, allow for mounting of decorative devices that would consequently have rotational axis movement.

Thus the examples given should not determine the scope of this invention. Rather, the scope of the invention should be determined by the appended claims and their legal equivalents.

What is claimed is:

1. A temporary puppet rod/wrist connection and movement system comprising:

a.) A split cylindrical foam support structure encasing a base, containing a slotted tube, with a clip attached to the tube in a perpendicular manner within the slot with said slot and clip positioned anywhere along the length of said tube with said attached clip device extending into the interior diameter of the tube by means of the slot with said tube attached to said base with appropriately sized bolt retainers or similar fastening devices;

b.) Said slotted tube and attached clip device of sufficient size to accommodate appropriately sized rod;

c.) Means for temporarily securing said rod to said slotted tube with attached clip device by friction from the clip against the rod upon insertion of the rod past the point of engaging the clip in the interior of the tube;

d.) Means for frequent and repeated connection, frequent and repeated disconnection and rotational movement of the rod while in the tube.

2. A temporary connection and movement system comprising:

a.) A base, containing a slotted tube, with a clip attached to the tube in a perpendicular manner within the slot with said slot and clip positioned anywhere along the length of said tube with said attached clip device extending into the interior diameter of the tube by means of the slot with said tube attached to said base with appropriately sized bolt retainers or similar fastening devices;

b.) Said slotted tube and attached clip device of sufficient size to accommodate appropriately sized rod;

c.) Means for temporarily securing said rod to said slotted tube with attached clip device by friction from the clip against the rod upon insertion of the rod past the point of engaging the clip in the interior of the tube;

d.) Means for frequent and repeated connection, frequent and repeated disconnection and rotational movement of the rod while in the tube.

* * * * *